US005511940A

United States Patent [19]

Boyd

[11] Patent Number: 5,511,940

[45] Date of Patent: Apr. 30, 1996

[54] CERAMIC TURBINE NOZZLE

[75] Inventor: Gary L. Boyd, Alpine, Calif.

[73] Assignee: Solar Turbines Incorporated, San Diego, Calif.

[21] Appl. No.: 369,238

[22] Filed: Jan. 6, 1995

[51] Int. Cl.[6] ..... F04D 29/60

[52] U.S. Cl. ..... 415/209.2; 415/209.3; 415/200

[58] Field of Search ..... 415/209.3, 209.2, 415/208.1, 200; 416/223 R, 223 A

[56] References Cited

U.S. PATENT DOCUMENTS

| | | | |
|---|---|---|---|
| 730,363 | 6/1903 | Geisenhoner . | |
| 792,659 | 6/1905 | Junggren | 415/209.2 |
| 2,599,654 | 6/1952 | Musikant | 415/208.1 |
| 2,853,271 | 9/1958 | Findley . | |
| 4,260,327 | 4/1981 | Armor et al. | 415/200 |
| 4,768,924 | 9/1988 | Carrier et al. | 415/200 |
| 5,380,154 | 1/1995 | Norton et al. | 415/209.3 |

*Primary Examiner*—John T. Kwon
*Attorney, Agent, or Firm*—Larry G. Cain

[57] ABSTRACT

A turbine nozzle vane assembly having a preestablished rate of thermal expansion is positioned in a gas turbine engine and being attached to conventional metallic components. The metallic components having a preestablished rate of thermal expansion being greater than the preestablished rate of thermal expansion of the turbine nozzle vane assembly. The turbine nozzle vane assembly includes an outer shroud and an inner shroud having a plurality of horizontally segmented vanes therebetween being positioned by a connecting member positioning segmented vanes in functional relationship one to another. The turbine nozzle vane assembly provides an economical, reliable and effective ceramic component having a preestablished rate of thermal expansion being greater than the preestablished rate of thermal expansion of the other component.

10 Claims, 4 Drawing Sheets

CERAMIC TURBINE NOZZLE

TECHNICAL FIELD

This invention relates generally to a gas turbine engine and more particularly to a turbine nozzle being made of a ceramic material.

BACKGROUND ART

"The Government of the United States of America has rights in this invention pursuant to Contract No. DE-AC02-92CE40960 awarded by the U.S. Department of Energy."

In operation of a gas turbine engine, air at atmospheric pressure is initially compressed by a compressor and delivered to a combustion stage. In the combustion stage, heat is added to the air leaving the compressor by adding fuel to the air and burning it. The gas flow resulting from combustion of fuel in the combustion stage then expands through a nozzle which directs the hot gas to a turbine blade, delivering up some of its energy to drive the turbine and produce mechanical power.

In order to increase efficiency the nozzle has a preestablished aerodynamic contour. The axial turbine consists of one or more stages, each employing one row of stationary nozzle guide vanes and one row of moving blades mounted on a turbine disc. The aerodynamically designed nozzle guide vanes direct the gas against the turbine blades producing a driving torque and thereby transferring kinetic energy to the blades.

The gas typically entering through the nozzle is directed to the turbine at a rotor entry temperature from 850 degrees to at least 1200 degrees Centigrade. Since the efficiency and work output of the turbine engine are related to the entry temperature of the incoming gases, there is a trend in gas turbine engine technology to increase the gas temperature. A consequence of this is that the materials of which the nozzle vanes and blades are made assume ever-increasing importance of elevated temperature capability.

Historically, nozzle guide vanes and blades have been made of metals such as high temperature steels and, more recently, nickel/cobalt alloys. Furthermore, it has been found necessary to provide internal cooling passages in order to prevent oxidation. It has been found that ceramic coatings can enhance the heat resistance of nozzle guide vanes and blades. In specialized applications, nozzle guide vanes and blades are being made entirely of ceramic, thus, accepting even higher gas entry temperatures.

Ceramic materials are superior to metal in high-temperature capability and have a low linear thermal expansion coefficient. But, on the other hand, ceramic materials have negative drawbacks such as low fracture toughness.

When a ceramic structure is used to replace a metallic part or is combined with a metallic one, it is necessary to avoid excessive thermal stresses generated by an uneven temperature distribution or the difference between their linear thermal expansion coefficients. The ceramic components' different chemical composition, physical property and coefficient of thermal expansion to that of a metallic supporting structure result in undesirable stresses. A major portion of these stresses is thermal stress, which will be set up within the nozzle guide vanes and/or blades and between the nozzle guide vanes and/or blades and their supports when the engine is operating.

Furthermore, conventional nozzle and blade designs which are made from a metallic material are capable of absorbing or resisting these thermal stresses. The chemical composition of ceramic nozzles and blades do not have the desired characteristics to absorb or resist the thermal stresses. If the stress occurs in a tensile stress zone of the nozzle or blade a catastrophic failure may occur.

The present invention is directed to overcome one or more of the problems as set forth above.

DISCLOSURE OF THE INVENTION

In one aspect of the invention, a nozzle guide vane assembly is comprised of an outer shroud defining an inner surface. An inner shroud positioned radially within the outer shroud and defining a first end, a second end, an inner surface and an outer surface. A plurality of segmented vanes are interposed the inner surface of the outer shroud and the outer surface of the inner shroud. And, an apparatus for positioning includes a connecting member positioning segmented vanes in functional relationship one to another is comprised therein.

BEST MODE FOR CARRYING OUT THE INVENTION

Figure 1:
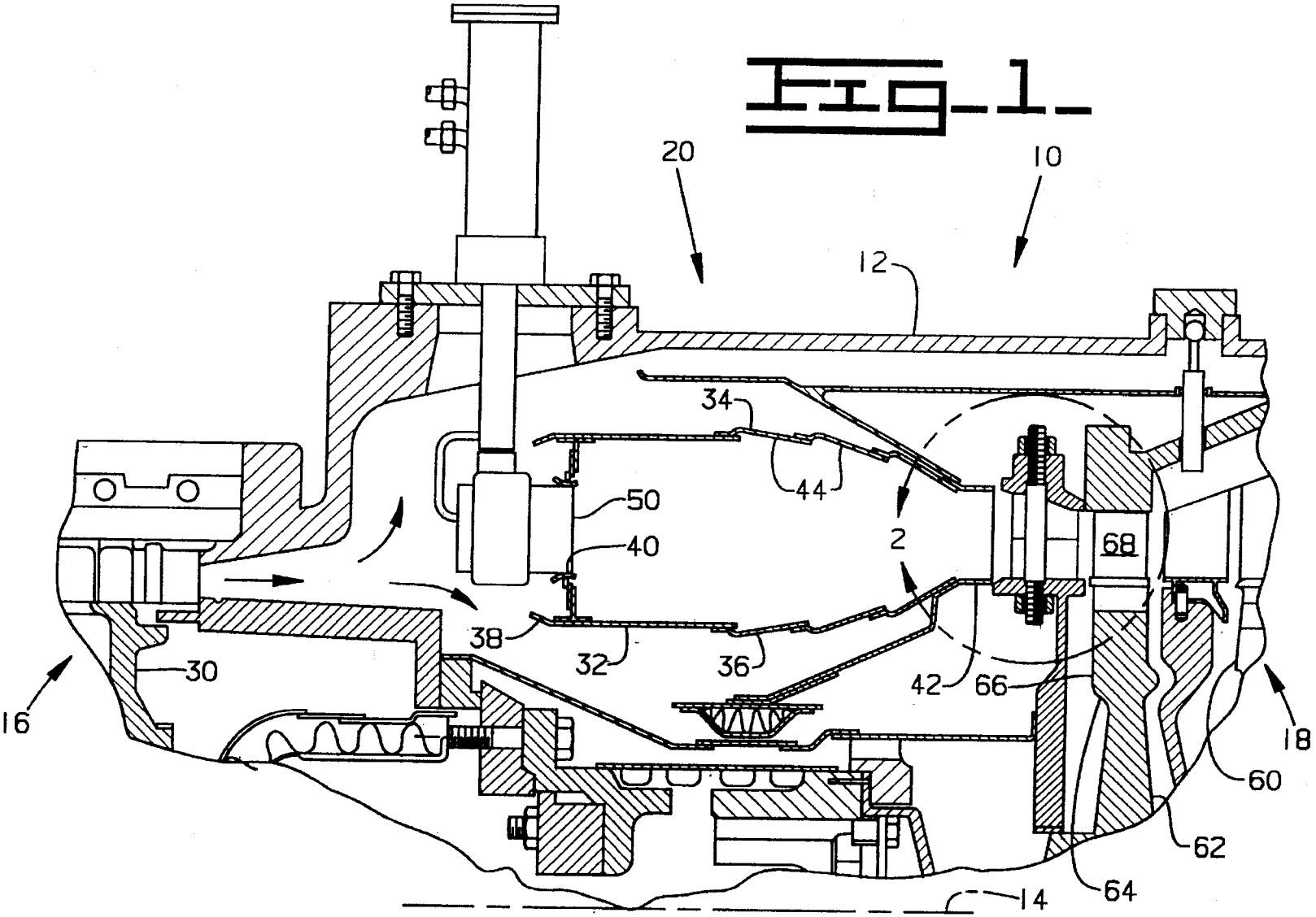
FIG. 1 is a partial side view of a gas turbine engine shown in section for illustration convenience embodying the present invention with portions.

Referring to FIG. 1, a gas turbine engine 10 is shown. The gas turbine engine 10 has an outer housing 12 having a central axis 14. Positioned in the housing 12 and centered about the axis 14 is a compressor section 16, a turbine section 18 and a combustor section 20 positioned operatively between the compressor section 16 and the turbine section 18.

When the engine 10 is in operation, the compressor section 16, which in this application includes an axial staged compressor 30 or, as an alternative, a radial compressor or any source for producing compressed air, causes a flow of compressed air which has at least a part thereof communicated to the combustor section 20 and another portion used for cool components of the gas turbine engine 10. The combustor section 20, in this application, includes an annular combustor 32. The combustor 32 has a generally cylindrical outer shell 34 being coaxially positioned about the central axis 14, a generally cylindrical inner shell 36, an inlet end 38 having a plurality of generally evenly spaced openings 40 therein and an outlet end 42. In this application, the combustor 32 is constructed of a plurality of generally conical segments 44. Each of the openings 40 has an injector 50 positioned therein. As an alternative to the annular combustor 32, a plurality of can type combustors could be incorporated without changing the essence of the invention.

The turbine section 18 includes a power turbine 60 having an output shaft, not shown, connected thereto for driving an accessory component, such as a generator. Another portion of the turbine section 18 includes a gas producer turbine 62 connected in driving relationship to the compressor section 16. The gas producer turbine 62 includes a turbine assembly 64 being rotationally positioned about the central axis 14. The turbine assembly 64 includes a disc 66 having a plurality of blades 68 attached therein in a conventional manner.

Figure 2:
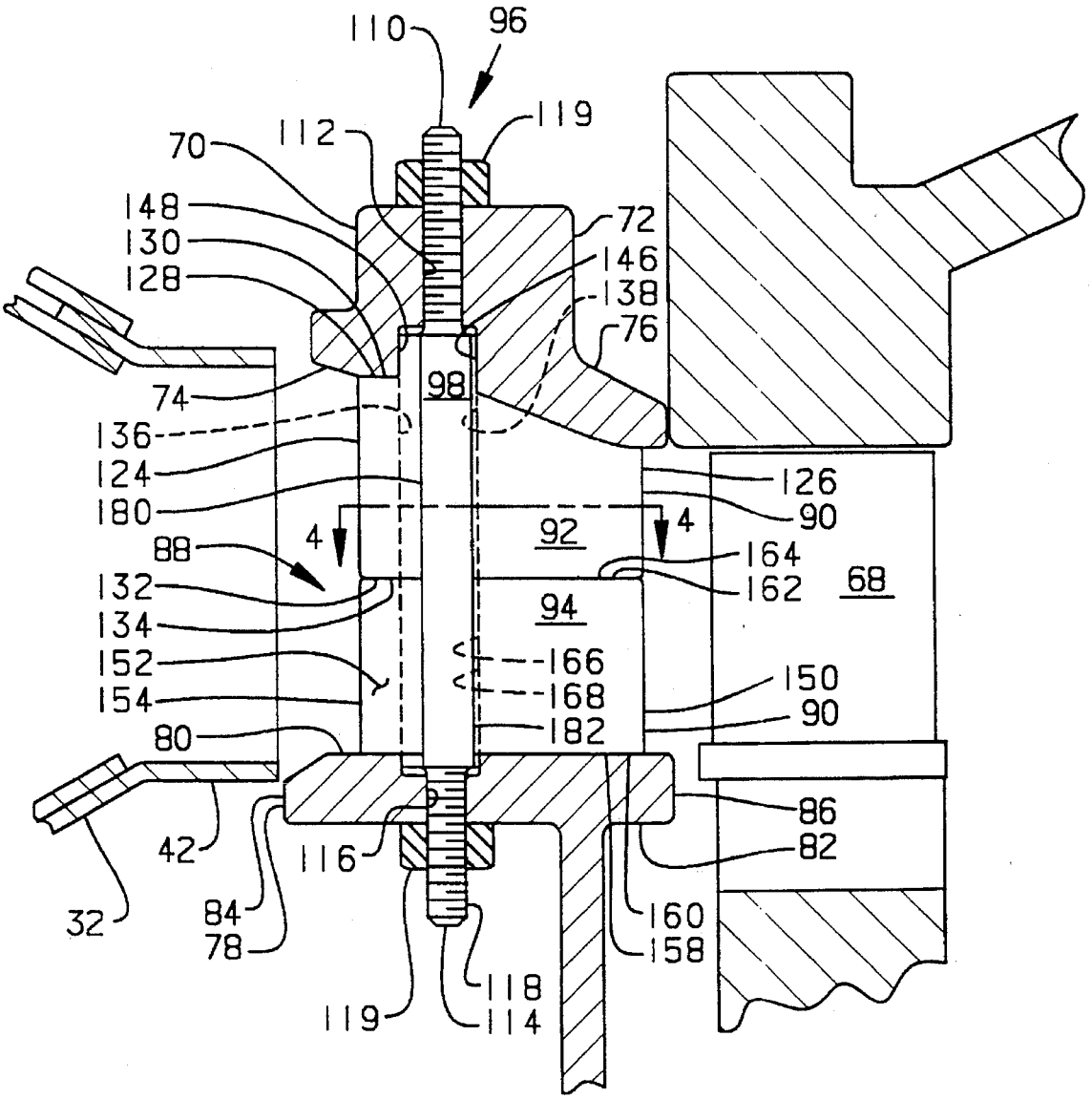
FIG. 2 is an enlarged sectional view of a portion of the gas turbine engine having a segmented ceramic nozzle guide vane assembly as taken generally within line 2 of FIG. 1.

As best shown in FIG. 2, positioned adjacent the outlet end 42 of the combustor 32 and in flow receiving communication therewith is a turbine nozzle vane assembly 70. The turbine nozzle vane assembly 70 includes a single piece outer shroud 72 defining a radial inner surface 74 and a radial outer surface 76, a single piece inner shroud 78 defining a radial inner surface 80, a radial outer surface 82, a first end 84 and a second end 86, and a plurality of segmented vanes 88 interposed the radial inner surface 74 of the outer shroud 72 and the radial outer surface 82 of the inner shroud 78. As an alternative, each of the outer shroud 72 and the inner shroud 78 could be segmented and as a further alternative could be made of a metallic material without changing the essence of the invention. In this application, each of the plurality of segmented vanes 88 has a preestablished rate of thermal expansion being less than the rate of thermal expansion of the metallic components of the engine 10. And, each of the plurality of segmented vanes 88 includes a plurality of vertically and/or horizontally separated segments 90 forming an first vane segment 92 and a second vane segment 94. Each of the first vane segments 92 and the second vane segments 94 are positioned in functional relationship one to another.

In this application, the apparatus includes a connecting member 98 having a first end 110 extending through one of a plurality of openings 112 in the outer shroud 72 and a second end 114 extending through one of a plurality of openings 116 in the inner shroud 78. The connecting member 98 is made of a ceramic material having a thermal expansion rate generally equal to that of the horizontally segmented vanes 90. In this application, the first end 110 and the second end 114 have a threaded portion 118 extending beyond each of the inner shroud 78 and the outer shroud 72. A nut 119 is removably attached to each of the threaded portion 118 of the ends 110,112 and interconnects the components forming the turbine nozzle vane assembly 70.

Figure 4:
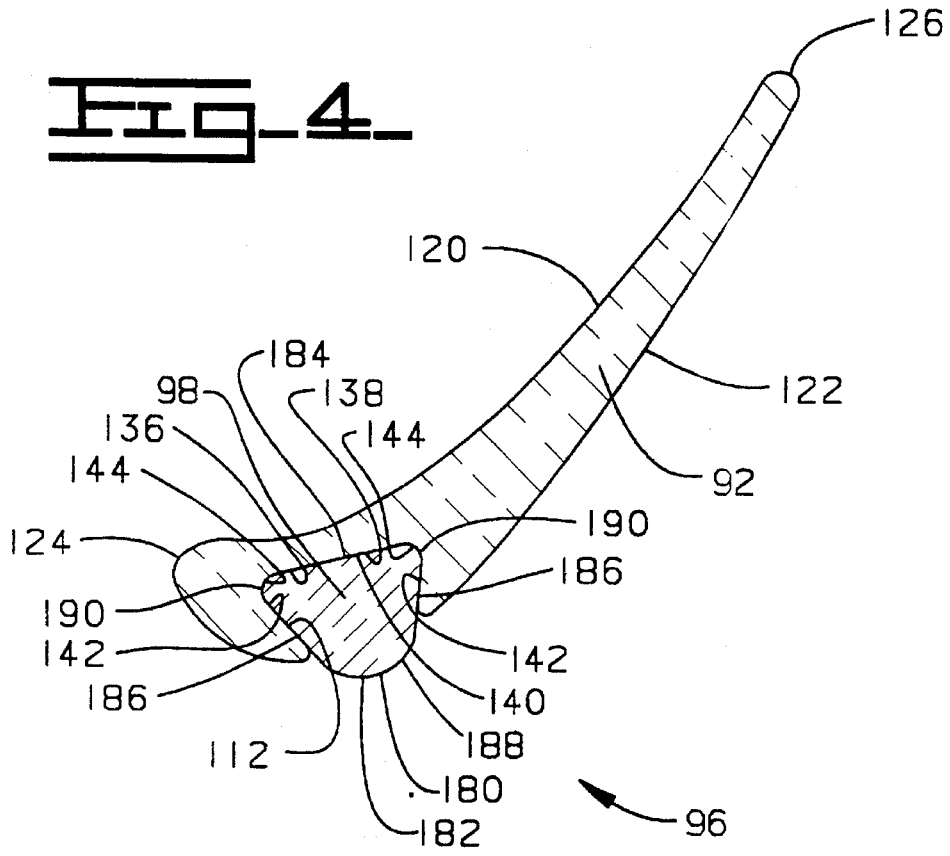
FIG. 4 is an enlarged sectional view of an apparatus for positioning individual segments of the segmented ceramic nozzle guide vane assembly one relative to another.

In this application, as best shown in FIGS. 2 and 4, each of the plurality of outer vane segments 92 includes a pressure side 120, a suction side 122, a leading edge 124, a trailing edge 126, a first end 128 having a mating surface 130 which has a configuration which blendingly meshes with the inner surface 74 of the outer shroud 72. A second end 132 has a mating surface 134 which, in this application, is a ground interface having a generally smooth flat surface. However, as an alternative, the mating surface 134 could be tapered or and any predetermined contour. A hole or opening 136 extends axially from the first end 128 to the second end 132 and is interposed the leading edge 124 and the trailing edge 126. The hole 136 has a preestablished contour 138, for example, in this application, the contour 138 includes a generally flat surface 140 interposed the pressure side 120 and the suction side 122, a pair of side wall portions 142 extending from the flat surface 140 at an included angle of about 60 degrees toward and intersecting with the suction side 122. The pair of side wall portion 142 are blendingly connected to the flat surface 140 by a pair of radius portions 144. An opening 146 having a preestablished contour 148 being equivalent to the preestablished contour 138 extends from the inner surface 74 of the outer shroud 72 toward the outer surface 76 a preestablished distance.

Each of the plurality of inner vane segments 94 includes a pressure side 150, not shown, a suction side 152, a leading edge 154, a trailing edge 156, a first end 158 having a mating surface 160 which has a configuration which blendingly meshes with the outer surface 82 of the inner shroud 78. A second end 162 has a mating surface 164 which, in this application, is a ground interface having a generally smooth flat surface which functionally interfaces and seals with the mating surface 134 of the second end 132 of the outer vane segment 92. A hole or opening 166 extends axially from the first end 128 to the second end 132 and is interposed the leading edge 154 and the trailing edge 156. The hole 166 has a preestablished contour 168 which is identical to that of the hole 136 in the outer vane segment 92. For example, in this application, the contour 168 includes a generally flat surface 170 interposed the pressure side 150 and the suction side 152, a pair of side wall portions 172 extending from the flat surface 170 at an included angle of about 60 degrees toward and intersecting with the suction side 152. The pair of side wall portion 172 are blendingly connected to the flat surface 170 by a pair of radius portions 174. An opening 176 having a preestablished contour 178 being equivalent to the preestablished contour 168 extends from the outer surface 80 of the inner shroud 78 toward the inner surface 82 a preestablished distance.

The connecting member 98 further includes a body portion 180 being defined by a preestablish contour 182 which is in contacting relationship with the hole 136 in the outer vane segment 92 and the hole 166 in the inner vane segment 94. For example, the contour 182 of the body portion 180 includes a generally flat surface 184, a pair of legs 186 extending from the flat surface 184 at an included angle of about 60 degrees and being connected at an opposite end by a radius member 188. Each end of the pair of legs 186 are blendingly connected to the flat surface 184 by a radius portions 190. The body portion 180 is blending connected to each of the threaded end portion 116 on each of the first end 110 and the second end 114.

Figure 3:
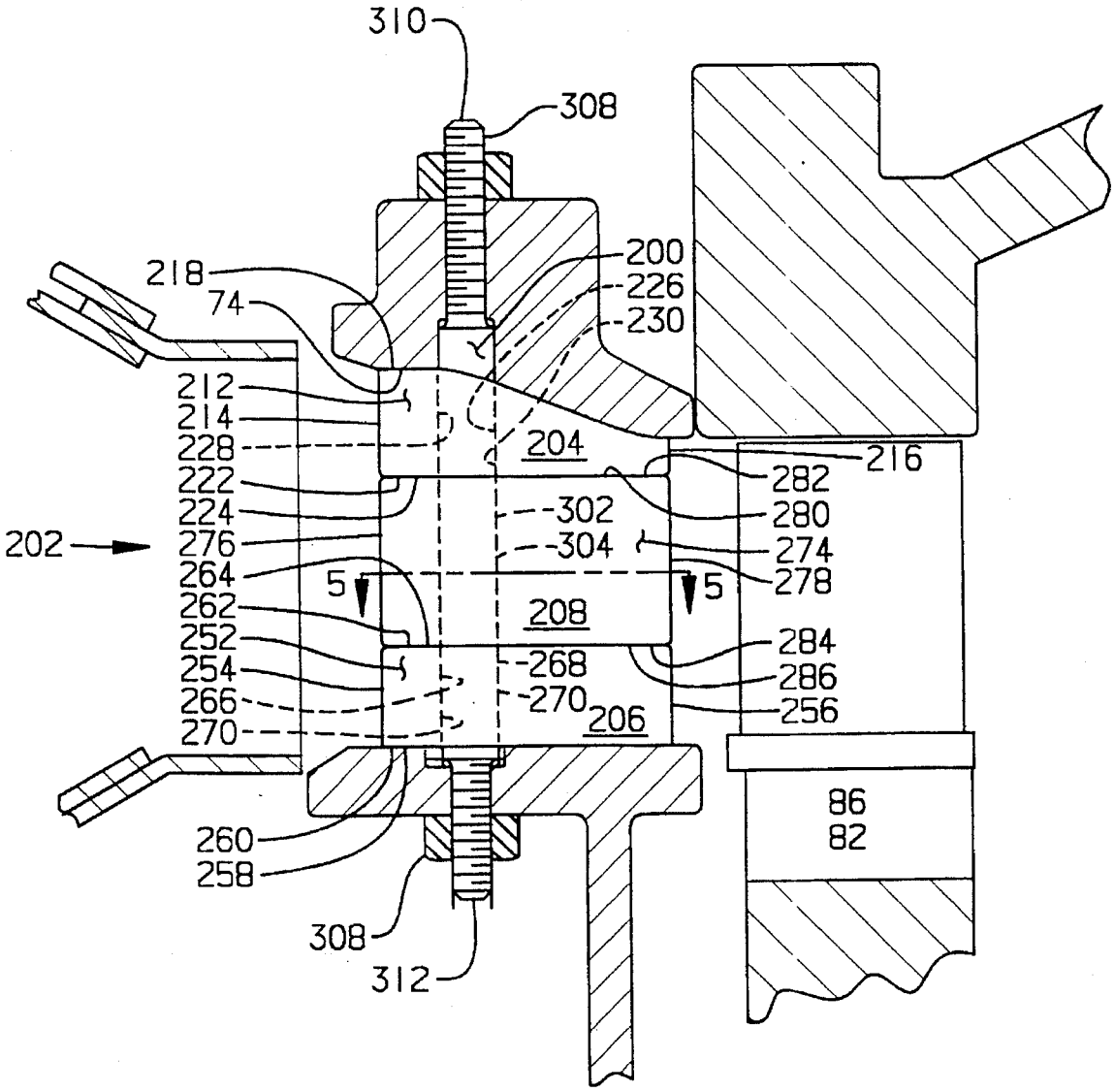
FIG. 3 is an enlarged sectional view of an alternative segmented ceramic nozzle guide vane assembly.
Figure 5:
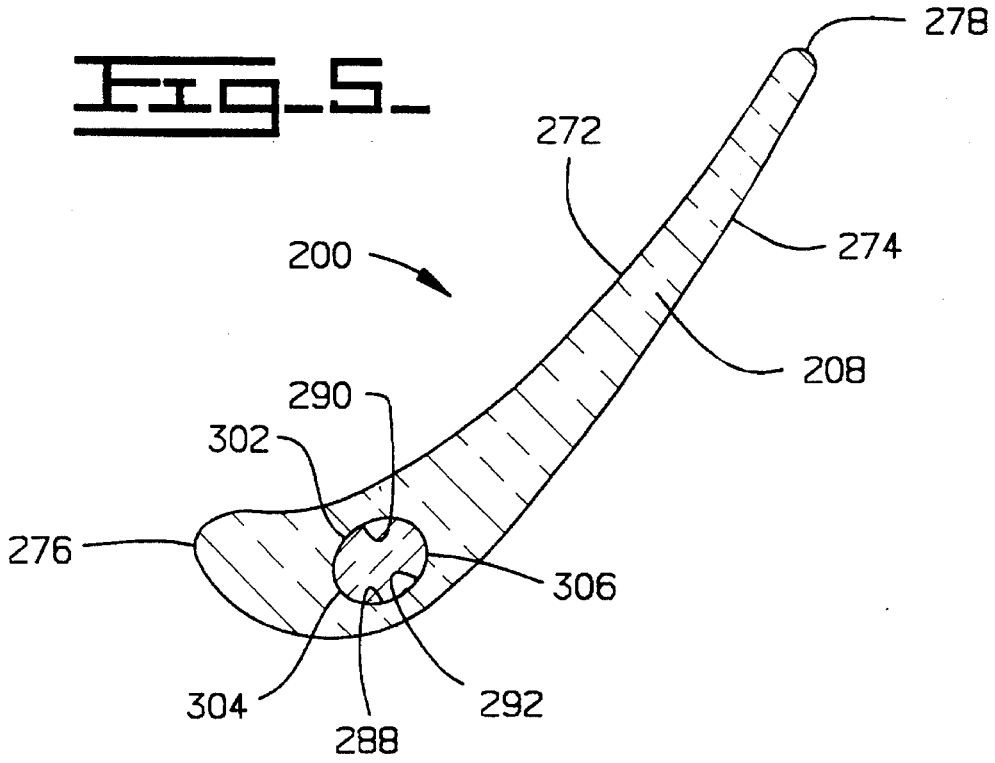
FIG. 5 is an enlarged sectional view of an alternative apparatus for positioning individual segments of the segmented ceramic nozzle guide vane assembly one relative to another.

An alternative connecting member 200 and plurality of segmented vanes 202 are best shown in FIGS. 3 and 5. The plurality of segmented vanes 202 include an outer vane segment 204, an inner vane segment 206 and an intermediate vane segment 208. Each of the outer vane segments includes a pressure side 210, not shown, a suction side 212, a leading edge 214, a trailing edge 216, a first end 218 having a mating surface 220 which has a configuration which blendingly meshes with the inner surface 74 of the outer shroud 72. A second end 222 has a mating surface 224 which, in this application, is a ground interface having a generally smooth flat surface which, when assembled, functionally interfaces and seals with a portion of the intermediate vane segment 208. A hole or opening 226 extends axially from the first end 218 to the second end 222, has a preestablished contour 228 and is interposed the leading edge 214 and the trailing edge 216. For example, in this application, the contour 228 includes a generally elliptical surface 230 interposed the pressure side 210 and the suction side 212. The elliptical surface 230 is further interposed the pressure side 210 and the suction side 212.

Each of the inner vane segments 206 includes a pressure side 250, not shown, a suction side 252, a leading edge 254, a trailing edge 256, a first end 258 having a mating surface 260 which has a configuration which blendingly meshes with the outer surface 80 of the inner shroud 78. A second end 262 has a mating surface 264 which, in this application, is a ground interface having a generally smooth flat surface which, when assembled, functionally interfaces and seals with a portion of the intermediate vane segment 208. A hole or opening 266 extends axially from the first end 258 to the second end 262 and is interposed the leading edge 254 and the trailing edge 256. The hole 266 has a preestablished contour 268 which is identical to that of the hole 226 in the outer vane segment 204. For example, in this application, the contour 268 includes a generally elliptical surface 270 interposed the pressure side 250 and the suction side 252, and the leading edge 254 and the trailing edge 256.

The intermediate vane segment 208 includes a pressure side 272, a suction side 274, a leading edge 276, a trailing edge 278, a first end 280 having a mating surface 282 which, in this application, is a ground interface having a generally smooth flat surface which, when assembled, functionally interfaces and seals with the mating surface 224 of the second end 222 of the outer vane segment 204. A second end 284 has a mating surface 286 which, in this application, is a ground interface having a generally smooth flat surface which, when assembled, functionally interfaces and seals with the mating surface 264 of the second end 262 of the inner vane segment 206. A hole or opening 288 extends axially from the first end 280 to the second end 284 and is interposed the leading edge 276 and the trailing edge 278. The hole 288 has a preestablished contour 290 which is identical to that of the hole 226 in the outer vane segment 204 and the hole 266 in the inner vane segment 208. For example, in this application, the contour 290 includes a generally elliptical surface 292 interposed the pressure side 272 and the suction side 274, and the leading edge 276 and the trailing edge 278.

The alternative connecting member 200 includes a body portion 302 being defined by a preestablished contour 304 which is in contacting relationship with the preestablished contour 228 of the hole 226 in the outer vane segment 204, the preestablished contour 268 of the hole 266 in the intermediate vane segment 206, and the preestablished contour 288 of the hole 286 in the inner vane segment 208. For example, the contour 304 of the body portion 302 includes a generally elliptical surface 306. The body portion 302 is blending connected to each of a threaded end portion 308 on each of a first end 310 and a second end 312.

Thus, a turbine nozzle vane assembly 70 having a segmented vane 88,202 is provided to compensate for thermal induced stress. The plurality of horizontally separated segments 90 allows the segment 94,206,92,204 of the segmented vane 88,202 nearest the inner shroud 78 and the outer shroud 72 to operate at a cooler temperature while the center structure can operate at a higher temperature without having critically high thermally induced stresses therein.

Industrial Applicability

In use, the gas turbine engine 10 is started and allowed to warm up and is used in any suitable power application. As the demand for load or power is increased, the engine 10 output is increased by increasing the fuel and subsequent air resulting in the temperature within the engine 10 increasing. The components used to make up the turbine nozzle vane assembly 70 and the attachment components, being of different materials and having different rates of thermal expansion, grow at different rates and the forces resulting therefrom and acting thereon must be structurally compensated for to increase life and efficiency of the gas turbine engine. The structural arrangement of the turbine nozzle vane assembly 70 being made of a ceramic material requires that the turbine nozzle vane assembly 70 be generally isolated from the conventional materials and mounting designs. The structural characteristics of the vanes 88, being made of a ceramic material, further complicates the design since thermal stresses within the vane 88 must be compensated for to insure sufficient life of the components.

For example, the turbine nozzle vane assembly 70 which is in direct contact and aligned with the mainstream hot gases from the combustor 42 is suspended from the metallic components of the engine 10. The turbine nozzle vane assembly 70 is supported from the metallic engine components in a conventional manner. Thermal expansion in the radial direction is compensated for by using a plurality of horizontally segmented vane segments 90. Each of the segments can move independently relative to the other segments. For example, the hot combustion gas passing near the inner and outer shroud 78,72 dissipate a greater amount heat to the inner and outer shroud 78,72 since these components are attached to cooler engine components and are in turn cooler. Thus, the vane portion nearest to the inner and outer shroud 78,72 will be cooler than the vane portion nearest the center between the inner and outer shroud 78,72. With the horizontally segmented vane 90, the outer vane segments 94,204 can expand and contract a small amount due to the relative location to the outer shroud 72 which is relatively cool. The inner vane segment 94,206 can also expand and contract a small amount due to the relative location to the inner shroud 78 which is relatively cool. Whereas, the intermediate vane segment 208 can expand and contract a relative large amount due to the heat relationship to the inner and outer shroud 78,72 and the hot combustion gas relationship.

Thus, in view of the foregoing, it is readily apparent that the structure of the present invention results in the internal stress in the tensile stressed region of each of the plurality of vanes 88 being reduced. The general reduction of the tensile stresses reduces the possibility of catastrophic failure of each of the plurality of ceramic turbine nozzle vanes 88. Furthermore, the relative difference in thermal expansion between the metallic components and the ceramic components and the mounting therebetween has been compensated for by use of horizontally segmented vane segments 90.

Other aspects, objects and advantages of this invention can be obtained from a study of the drawings, the disclosure and the appended claims.

What is claimed is:

1. A turbine nozzle vane assembly comprising:

an outer shroud defining an inner surface;

an inner shroud positioned radially within said outer shroud and defining a first end, a second end, an inner surface and an outer surface;

a plurality of segmented vanes being interposed the inner surface of the outer shroud and the outer surface of the inner shroud, each of said plurality of segmented vanes including a hole having a preestablished contour;

said preestablished contour includes a generally flat surface and a pair of side wall portion extending from the flat surface at an included angle of about 60 degrees; and an apparatus for positioning including a connecting member positioning said segmented vanes.

2. The turbine nozzle vane assembly of claim 1 wherein said plurality of segmented vanes include a plurality of horizontally separated segments.

3. The turbine nozzle vane assembly of claim 1 wherein said plurality of segmented vanes have a preestablished rate of thermal expansion and said apparatus for positioning has a generally equal rate of thermal expansion.

4. The turbine nozzle vane assembly of claim 3 wherein said outer shroud and said inner shroud have a rate of thermal expansion being generally equal to the rate of thermal expansion of the plurality of segmented vanes.

5. The turbine nozzle vane assembly of claim 1 wherein each of said plurality of segmented vanes define a first end, a second end, a pressure

6. The turbine nozzle vane assembly of claim 5 wherein said generally flat surface is interposed the pressure side and the suction side and said pair of side wall portion extending from the flat surface at the included angle of about 60 degrees extends toward and intersecting with the suction side.

7. The turbine nozzle vane assembly of claim 6 wherein said connecting member includes a body portion having a generally flat surface and a pair of legs extending from the flat surface at an included angle of about 60 degrees.

8. The turbine nozzle vane assembly of claim 7 wherein said generally flat surface of the body portion is in contacting relationship to the flat surface of the preestablished contour of the hole and said pair of legs are in contacting relationship to the pair of side wall portions of the hole.

9. The turbine nozzle vane assembly of claim 1 wherein each of said plurality of segmented vanes includes an outer vane segment and an inner vane segment.

10. The turbine nozzle vane assembly of claim 1 wherein each of said plurality of segmented vanes include an outer vane segment, an inner vane segment and an intermediate vane segment.

* * * * *

UNITED STATES PATENT AND TRADEMARK OFFICE

CERTIFICATE OF CORRECTION

PATENT NO. : 5,511,940

DATED : April 30, 1996

INVENTOR(S) : Gary L. Boyd

It is certified that error appears in the above-identified patent and that said Letters Patent is hereby corrected as shown below:

Column 7, line 17, claim 5, please insert after "a pressure",

"side, a suction side, a leading edge, a trailing edge and a hole extending between the first end, and the second end, said hole including a preestablished contour."

Signed and Sealed this

Fifteenth Day of April, 1997

Bruce Lehman

*Attest:*

BRUCE LEHMAN

*Attesting Officer*

*Commissioner of Patents and Trademarks*